US007162150B1

(12) United States Patent
Welch et al.

(10) Patent No.: US 7,162,150 B1
(45) Date of Patent: Jan. 9, 2007

(54) THERMISTOR SENSOR PROBE WITH BIMETAL HIGH LIMIT CONTROL FOR ELECTRIC WATER HEATER CONTROL

(75) Inventors: Richard E. Welch, Lexington, OH (US); Tung-Sheng Yang, Mansfield, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 0 days.

(21) Appl. No.: 11/287,005

(22) Filed: Nov. 23, 2005

(51) Int. Cl.
*F24H 1/20* (2006.01)

(52) U.S. Cl. ..... 392/455; 392/497

(58) Field of Classification Search ..... None
See application file for complete search history.

(56) References Cited

U.S. PATENT DOCUMENTS 5,335,311 A * 8/1994 Groothuizen ..... 204/196.11
5,347,610 A * 9/1994 Lee ..... 392/447
5,371,831 A * 12/1994 Gauer et al. ..... 392/501
5,404,421 A * 4/1995 Wallace et al. ..... 392/455
5,586,214 A * 12/1996 Eckman ..... 392/503
6,069,998 A * 5/2000 Barnes et al. ..... 392/498
6,137,955 A * 10/2000 Krell et al. ..... 392/454
6,210,208 B1 * 4/2001 Barnes et al. ..... 439/441
6,300,607 B1 * 10/2001 Steinhauser et al. ..... 219/544
6,308,009 B1 * 10/2001 Shellenberger et al. ..... 392/454
6,337,470 B1 * 1/2002 Von Arx et al. ..... 219/544
6,611,660 B1 * 8/2003 Sagal ..... 392/497
6,786,182 B1 * 9/2004 Morgandi et al. ..... 122/4 A

* cited by examiner

*Primary Examiner*—Thor S. Campbell
(74) *Attorney, Agent, or Firm*—Harness, Dickey & Pierce, PLC

(57) ABSTRACT

A bracket operable to support a temperature control device and a sensor probe at an external surface of a water tank for controlling and monitoring the water temperature of the tank. The bracket comprises a first receptacle, a second receptacle, and a coupling feature. The first receptacle is operable to receive the temperature control device. The second receptacle is operable to receive the sensor probe. The coupling feature is operable to attach the bracket at the external surface of the water tank.

25 Claims, 5 Drawing Sheets

THERMISTOR SENSOR PROBE WITH BIMETAL HIGH LIMIT CONTROL FOR ELECTRIC WATER HEATER CONTROL

FIELD OF THE INVENTION

The present invention generally relates to temperature control devices. Specifically, the present invention relates to a bracket for mounting a temperature control device at an external surface of a water tank.

BACKGROUND OF THE INVENTION

Conventional electric water heater tanks include a heating element operable to heat water stored within the tank. The heating element is mounted to a water tank flange that protrudes from an external surface of the water tank. The heating element includes an internal portion that extends into at least part of the tank interior and an external portion that protrudes from the water tank flange.

A mount is secured to the external portion of the water tank flange. In conventional electric water heater tanks the mount directly supports a temperature control thermostat. The temperature control thermostat includes a bimetal disc that is in contact with the exterior surface of the water tank. The bimetal disc undergoes physical changes in response to changes in the temperature of the water in the tank.

A high-limit thermostat is mounted directly to the control thermostat. The high-limit thermostat prevents the heating element from heating the water above a predetermined high-limit temperature. The high-limit thermostat includes a bimetal disc that is in contact with the exterior surface of the water tank. When the temperature of the water within the tank increases above the predetermined limit, the bimetal disc undergoes a physical change. In response to this physical change, the high-limit thermostat opens a switch that deactivates the heating element.

While conventional temperature control thermostats are suitable for their intended uses, they are subject to improvement. For example, bimetal temperature control thermostats are being replaced with electronic temperature control systems on an increasing basis. Electronic temperature control systems provide enhanced temperature control, as well as numerous other features.

In some electronic control systems, the temperature control thermostat is replaced with an electronic control unit and a sensor probe. The sensor probe is typically mounted at the exterior surface of the water tank. The sensor probe transmits signals to the control unit indicative of the temperature of the water within the tank. The control unit processes the signals from the sensor probe and controls the heating element, as needed, to bring the water to a desired set-point temperature, which is established by programming the control unit.

Because the bimetal temperature control thermostat, which conventionally supports the high limit thermostat, is not used in electronic temperature control systems, there is a need in electronic control systems for a device to support the high limit thermostat at the exterior surface of the water tank. There is also a need for a device to mount the sensor probe at the external surface of the water tank.

SUMMARY OF THE INVENTION

The present invention improves upon the prior art by providing a bracket, for use with a hot water tank electronic temperature control system, that mounts both a sensor probe and a thermostat at an exterior surface of the hot water tank.

In one embodiment, the invention includes a bracket operable to engage a mount at an external surface of a water tank to support a temperature control device and a sensor probe at the exterior surface of the water tank for controlling and monitoring the water temperature of the water tank. The bracket comprises a first receptacle, a second receptacle, and a coupling feature. The first receptacle is operable to receive the temperature control device. The second receptacle is operable to receive the sensor probe. The coupling feature is operable to engage the mount at the external surface of the water tank.

In another embodiment, the invention includes a temperature control assembly for controlling and monitoring the water temperature of a water tank. The assembly is operable to cooperate with a mount at an external surface of a water tank. The assembly comprises a bracket, a thermostat, and a thermistor. The bracket has a coupling feature for cooperating with the mount at the external surface of the water tank. The thermostat and thermistor are supported by the bracket.

In an additional embodiment, the invention includes an installation for controlling and monitoring water temperature of a water tank. The installation comprises a mount, a bracket, a thermostat, a thermistor, and a control unit. The mount is in cooperation with an external surface of a water tank flange. The bracket is supported at the external surface of the water tank by the mount. The thermostat and thermistor are supported by the bracket. The control unit receives inputs from the thermistor representing the water temperature and transmits operating commands to the heating element based on the inputs.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
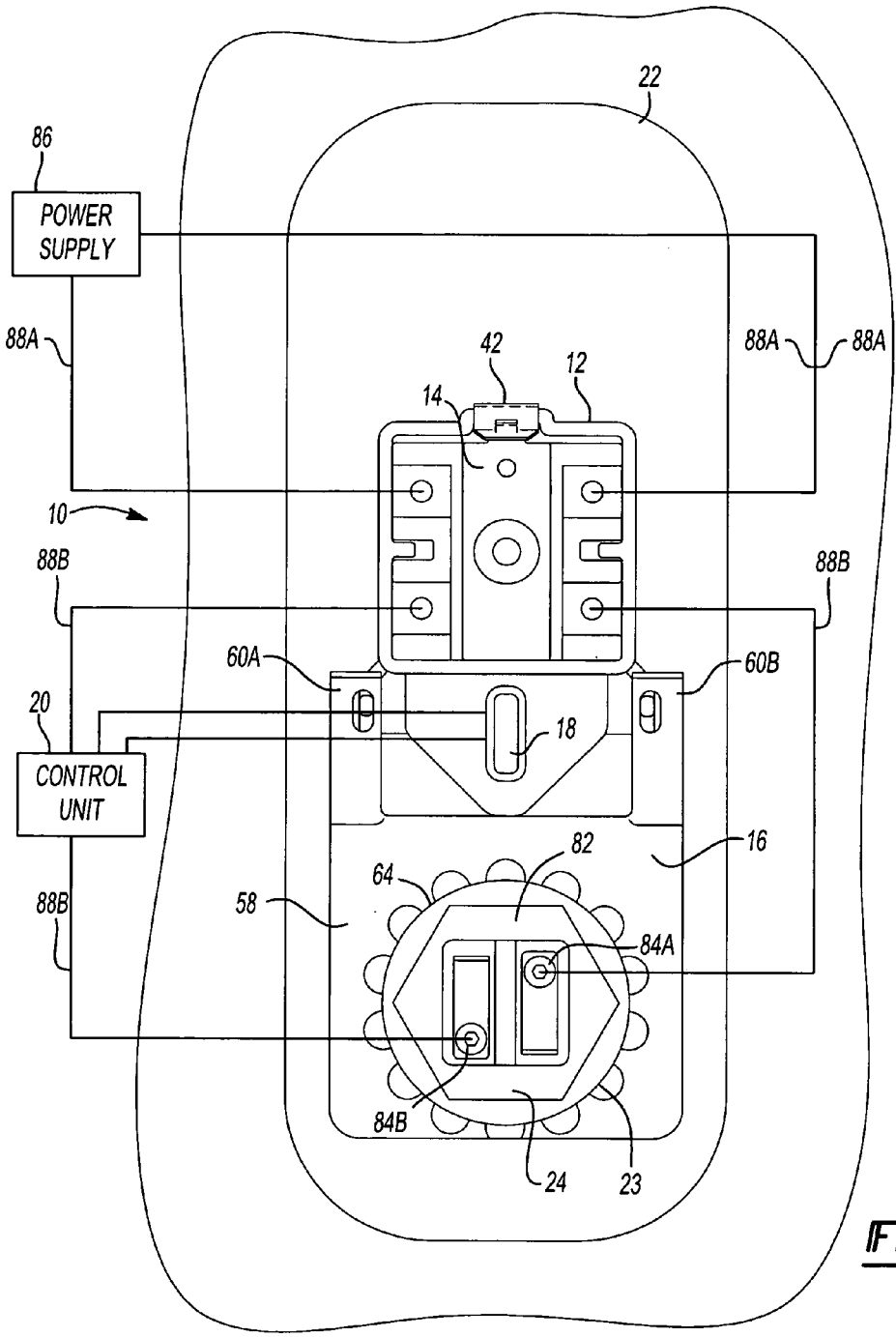
FIG. 1 is a plan view of an installation according to an embodiment of the present invention for controlling and monitoring water temperature of a water tank.
Figure 2:
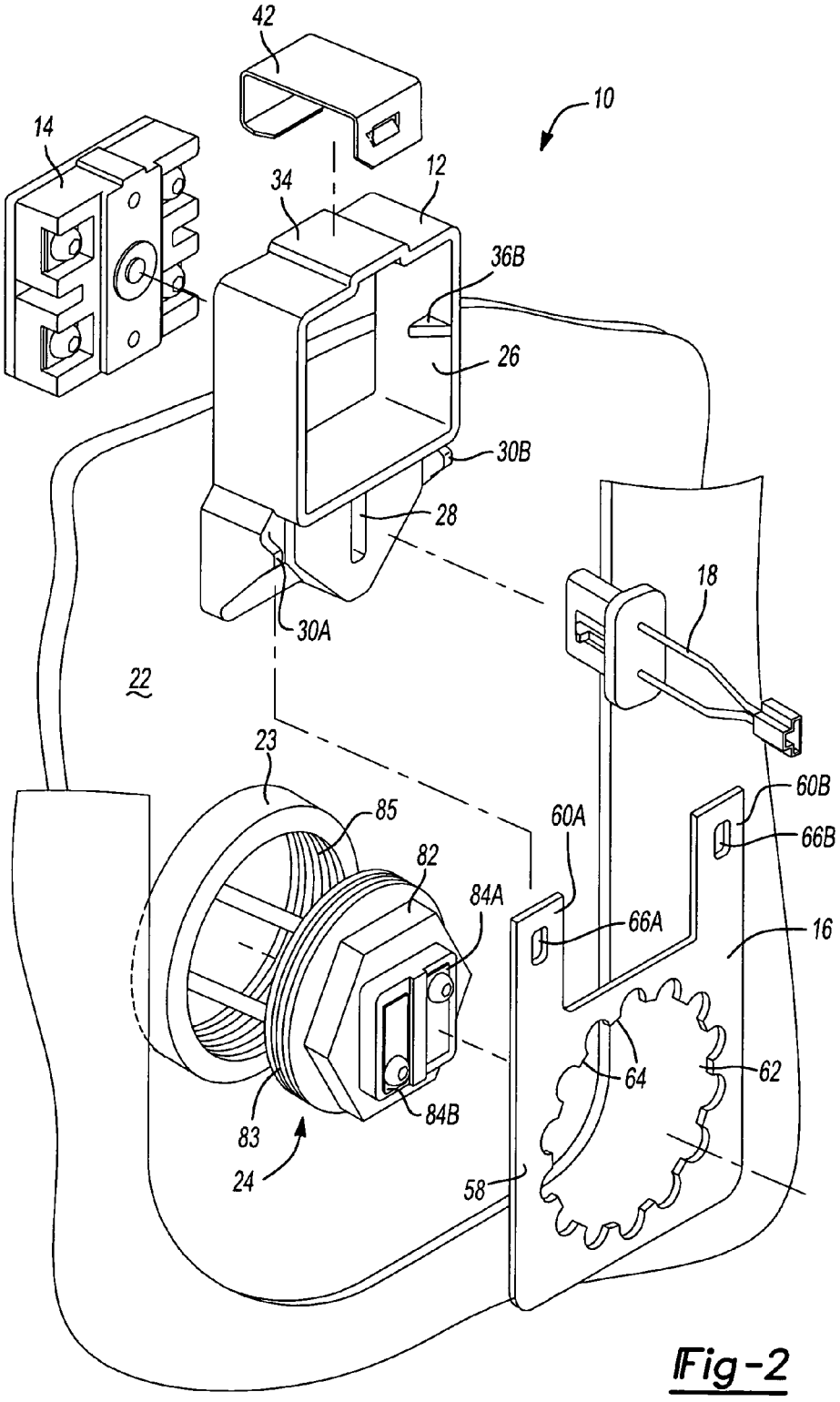
FIG. 2 is an exploded view of the installation of FIG. 1.

With initial reference to FIGS. 1 and 2, an installation for controlling and monitoring water temperature of a water tank according to an embodiment of the present invention is illustrated at reference numeral 10. The installation 10 generally includes a bracket 12, a thermostat 14, a mount 16, a sensor probe 18, and a control unit 20. The installation 10 is mounted at an exterior surface of a water tank 22. More specifically, the installation 10 is mounted to a water tank flange 23 that is welded to the exterior surface of the water tank 22.

Figure 3:
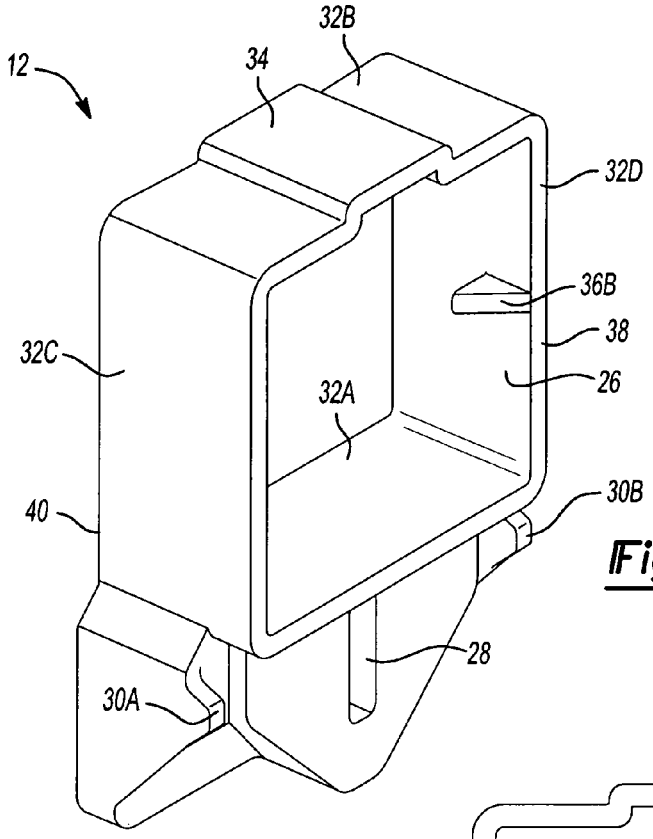
FIG. 3 is a three-quarter side view of a bracket of the installation of FIG. 1.
Figure 4:
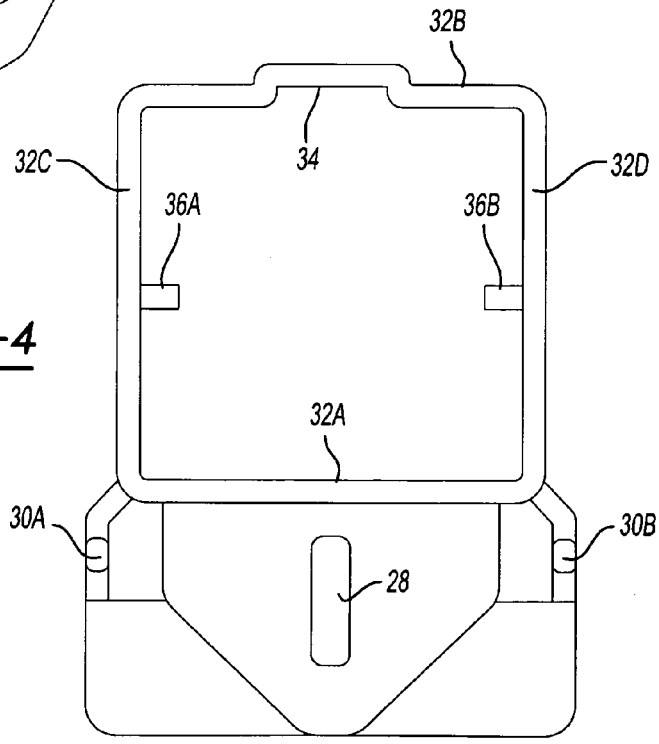
FIG. 4 is a plan view of the bracket of FIG. 3.
Figure 5:
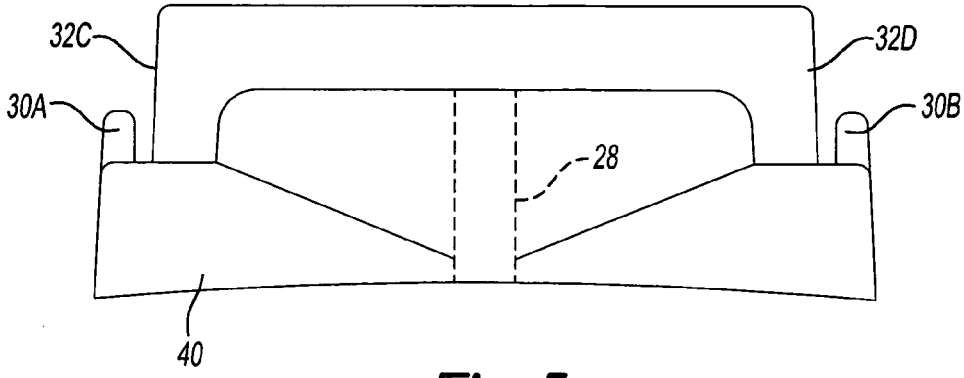
FIG. 5 is a side view of the bracket of FIG. 3.

With additional reference to FIGS. 3, 4, and 5, the bracket 12 generally includes a first receptacle 26, a second receptacle 28, and coupling features 30A and 30B.

The first receptacle 26 is defined by a first sidewall 32A, a second sidewall 32B, a third sidewall 32C, and a fourth sidewall 32D. The first side wall 32A is generally parallel to the second sidewall 32B. The third sidewall 32C and the fourth sidewall 32D are generally parallel to each other and perpendicular to the first and second sidewalls 32A and 32B. The second sidewall 32B includes an offset portion 34 that is parallel to and offset from the remainder of the second sidewall 32B.

The first receptacle 26 includes retaining tabs 36A and 36B. The tabs 36A and 36B are positioned on opposing interior surfaces of the third and fourth sidewalls 32C and 32D respectively. The tabs 36 can take the form of any suitable locking device or mechanism operable to secure the thermostat 14 within the first receptacle 26.

Figure 6:
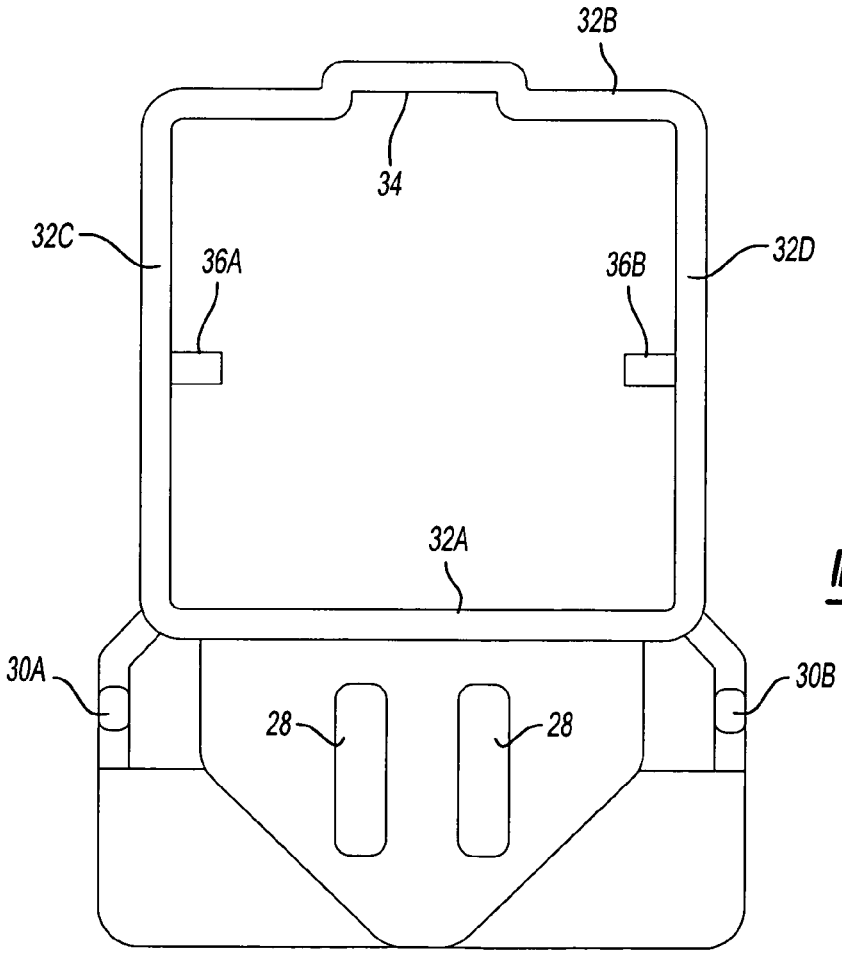
FIG. 6 is a plan view of a bracket of the installation of FIG. 1 according to an additional embodiment.

The second receptacle 28 is generally rectangular, but can be any suitable size or shape to receive the sensor probe 18. The bracket 12 can include a single receptacle 28 or multiple receptacles 28. For example, the bracket 12 can include a first receptacle 28A and a second receptacle 28B, as illustrated in FIG. 6.

As illustrated, the coupling features 30A and 30B are coupling posts that extend outward from the bracket 12. The coupling features 30 can be any suitable coupling feature operable to secure the bracket 12 to the mount 16.

The bracket 12 generally includes an upper surface 38 and a lower surface 40 that is opposite to the upper surface 38. With particular reference to FIG. 5, the lower surface 40 is contoured to at least generally correspond to the exterior surface of the water tank 22.

The bracket 12 can be manufactured of any suitable material capable of withstanding temperature changes. For example, in many applications the bracket 12 can be made of a suitable thermoplastic or thermal set molding material, such as phenolic molding powder.

Figure 7:
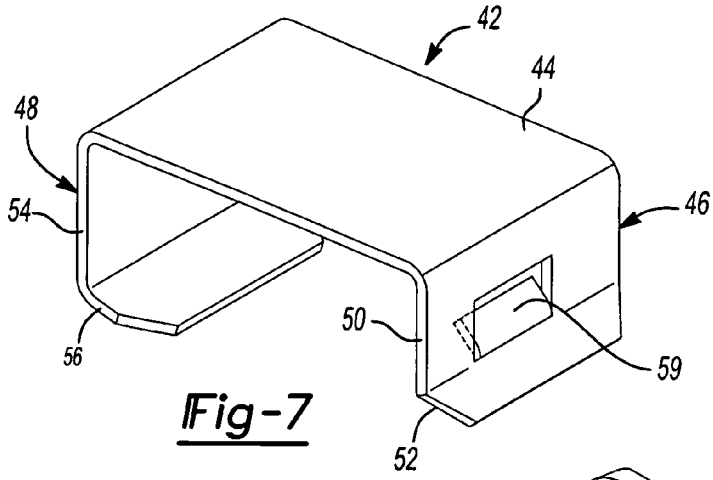
FIG. 7 is a perspective view of a clip of the installation of FIG. 1.

In some embodiments, the bracket 12 further includes a retaining clip 42 (FIG. 7) operable to engage the bracket 12 at the offset portion 34. The retaining clip 42 includes a base portion 44, a first flange 46, and a second flange 48.

The first flange 46 extends from one end of the base portion 44 and the second flange 48 extends from an opposite end of the base portion 44. The first flange 46 includes an inner portion 50 and an outer portion 52. The second flange 48 includes an inner portion 54 and an outer portion 56.

The base portion 44 is generally planar. The inner portion 50 of the first flange 46 extends from the base portion 44 at generally a 90° angle. The outer portion 52 is angled relative to the inner portion 50 such that it extends away from the second flange 48. The first flange 46 further includes a retaining tab 59 that is biased inward in the direction of the second flange 48. The tab 59 is generally a flexible tab.

The inner portion 54 of the second flange 48 extends from the base portion 44 at generally a 90° angle. The outer portion 56 is angled relative to the inner portion 54 such that it extends toward the first flange 46.

Again referring to FIG. 1, the thermostat 14 is any suitable high-limit temperature control thermostat operable to deactivate the heating element 24 when the temperature of the water tank 22 exceeds a predetermined temperature threshold. In some embodiments the predetermined temperature threshold is set at 180° F., +/−5° F. In some embodiments, a suitable thermostat 14 is a 66T series electric water heater control manufactured by Therm-O-Disc, Inc. of Mansfield, Ohio.

As illustrated in FIGS. 1 and 2, the mount 16 generally includes a base portion 58 and a pair of mounting flanges 60A and 60B.

The base portion 58 is generally planar. The base portion 58 includes an aperture 62. The aperture 62 is generally located at a center of the base portion 58. The base portion 58 includes a plurality of fingers 64 that extend from the base portion 58 into the aperture 62. The aperture 62 is sized to receive the water tank flange 23.

The flanges 60A, 60B are spaced apart at a distance approximately equal to the distance between the coupling features 30 of the bracket 12. Each flange 60A, 60B includes an opening 66A and 66B, respectively, that is sized to accommodate the coupling features 30. The flanges 60A, 60B are movable or flexible flanges.

The mount 16 can be made of any material suitable to the particular application. In some embodiments the mount 16 is made of a metal.

Figure 8:
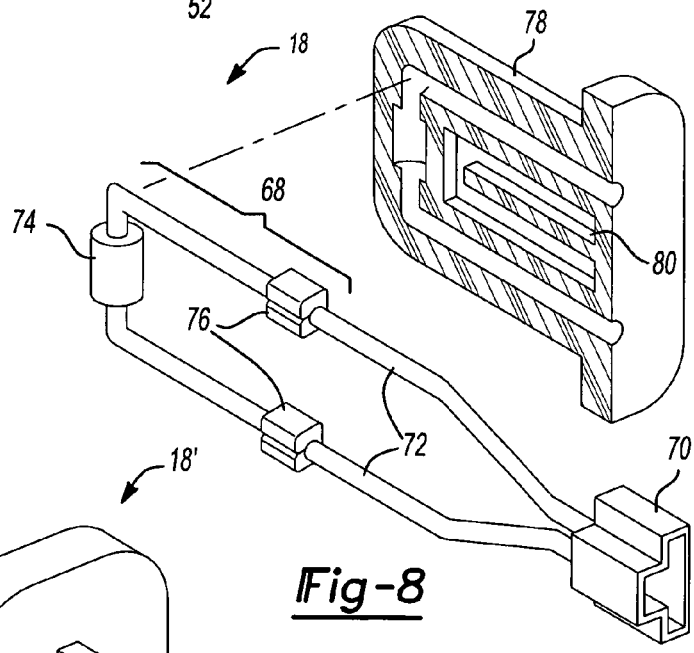
FIG. 8 is a perspective view of a sensor probe of the installation of FIG. 1 according to an embodiment of the present invention showing a cover of the probe exploded and in cross-section.
Figure 9:
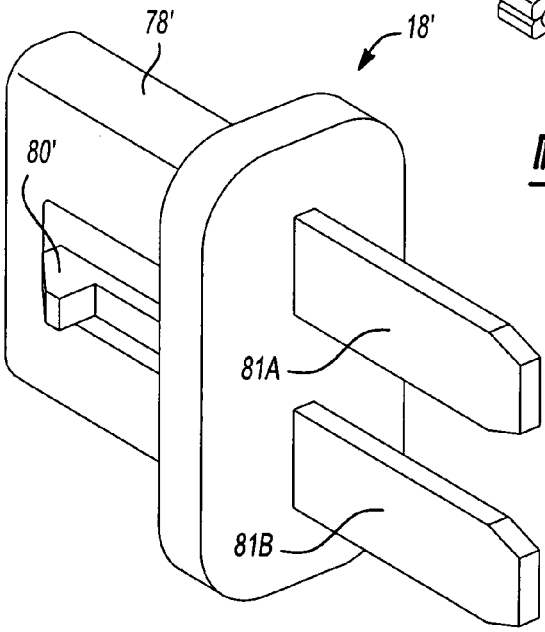
FIG. 9 is a perspective view of a sensor probe of the installation of FIG. 1 according to an additional embodiment of the present invention.

With additional reference to FIG. 8, the sensor probe 18 generally includes a sensing portion 68, a connector 70, and wires 72. The wires 72 join the sensing portion 68 to the connector 70.

The sensing portion 68 includes a thermistor 74. The thermistor 74 is joined to the wires 72 by crimpings 76, one on each side of the thermistor 74. The thermistor 74 can be a resistor or any other suitable device whose output can be calibrated for measuring temperature.

The sensing portion 68 is covered by a cover 78, which is illustrated in cross-section in FIG. 8. The cover 78 includes an engagement feature, such as a locking tab 80, that can engage the second receptacle 28 of the bracket 12 to secure the sensing portion 68 within the second receptacle 28. In some embodiments, the cover 78 is a thermal plastic that is insert molded over the thermistor 74. However, the cover 78 can be made of any other suitable material as well.

An additional embodiment of the sensor probe 18 is illustrated in FIG. 8 at reference numeral 18'. The sensor probe 18' is substantially similar to the sensor probe 18. Therefore, the description of the sensor probe 18 also applies to the sensor probe 18' and features in common between the two probes 18 and 18' are designated using the same reference number having the prime (') symbol. The only substantial difference between the sensor probe 18 and the sensor probe 18' is that the sensor probe 18' includes a pair of terminals 81A and 81B respectively in place of the wires 72 and the connector 70 of the probe 18.

As illustrated in FIGS. 1 and 2, the heating element 24 is an electric element that extends from the exterior of the water tank 22 through at least a portion of an interior of the water tank. The heating element includes a bolt 82 having threads 83. The threads 83 can cooperate with internal threads 85 of the water tank flange 23 to secure the heating element 24 to the flange 23. The heating element 24 further includes electrical contacts 84A and 84B at an external surface of the bolt 82. As illustrated in FIG. 1, the electrical contacts 84A and 84B are electrically connected to the thermostat 14 and the control unit 20 respectively using a suitable conductor, such as a conductive wire.

Operation of the installation 10 is controlled by the control unit 20. The control unit 20 can be any suitable control device, such as a micro-processor-based control, for example. The control unit 20 is in receipt of electrical outputs from the sensor probe 18 representing the water temperature of the water tank via a suitable conductive wire. The control unit 20 also opens and closes relays that turn on and off the heating elements.

The installation 10 is powered by a power supply 86. The power supply 86 can be any suitable power supply operable to power the installation 10. For example, in some embodiments the power supply 86 can be line voltage or a 240V power supply. In the embodiment illustrated at FIG. 1, the power supply 86 supplies power to the heating element 24 via a suitable conductive wiring.

The manner in which the different elements of the installation 10 are mounted at the exterior surface of the water tank 22 will now be described.

The mount 16 is secured to the water tank flange 23 by positioning the aperture 62 of the mount 16 over the flange 23. During installation of the mount 16 over the flange 23 the fingers 64 flex to accommodate the flange 23. When the mount 16 is in position, the fingers 64 of the aperture 62 engage the flange 23 to secure the mount 16 to the flange 23.

The thermostat 14 is seated within the first receptacle 26 of the bracket 12. The thermostat 14 is secured within the bracket 12 by the retaining tabs 36 and the retaining clip 42. Specifically, the thermostat 14 is inserted through the first receptacle 26 at the lower surface 40. The tabs 36 engage the thermostat 14 to prevent the thermostat 14 from passing through the first receptacle 26.

After the thermostat 14 is seated within the first receptacle 26 the clip 42 is fastened to the second sidewall 32B and the thermostat 14 to secure the thermostat 14 within the first receptacle 26. Specifically, the base portion 44 of the clip 42 is positioned at the offset portion 34 of second sidewall 32B. The second flange 48 wraps around the lower surface 40 at the second sidewall 32B to engage a lower surface of the thermostat 14. The first flange 46 wraps around the upper surface 38 at the second sidewall 32B and engages the second sidewall 32B through interaction between the retaining tab 59 and the offset portion 34. Thus, the clip 42 prevents the thermostat 14 from passing through the lower surface 40 of the first receptacle 26 and the tabs 36 prevent the thermostat 14 from passing through the upper surface 38 of the first receptacle 26.

The bracket 12 housing the thermostat 14 is secured at the exterior surface of the water tank 22 by the mount 16. Specifically, the bracket 12 is pushed into engagement with the mount 16 so that the coupling features 30 are received by the openings 66A and 66B of the mounting flanges 60A and 60B. The ability of the flanges 60A and 60B to flex facilitates cooperation between the coupling features 30 and the openings 66A and 66B. Securing the bracket 12 to the mount 16 brings the thermostat 14 into direct contact with the exterior surface of the water tank 22, thereby permitting the thermostat 14 to obtain an accurate temperature reading of the temperature of the water within the tank 22.

The sensor probe 18 is inserted within the second receptacle 28. The sensor probe 18 is retained within the second receptacle 28 through cooperation between the locking tab 80 and the second receptacle 28. The sensor probe 18 is positioned in direct contact with the exterior surface of the water tank 22 to permit the sensor probe 18 to obtain an accurate reading of the temperature of the water within the tank.

The thermostat 14 is electrically connected to the power supply 86 via conductive wires 88A. The thermostat 14 is also connected to the electrical contacts 84A and 84B of the heating element 24 via conductive wires 88B. Thus, the power supply 86, the thermostat 14, and the heating element 24 are electrically connected in a circuit. The control unit 20 is also present in the circuit between the thermostat 42 and the electrical contact 84B of the heating element 24.

The thermostat includes a bimetal disc that is in contact with the exterior surface of the water tank 22. The bimetal disc undergoes physical changes in response to changes in temperature of the water within the water tank. When the temperature of the water tank exceeds a high-limit set-point temperature, the disc opens a switch that opens the circuit comprising the power supply 86, the thermostat 42, and the heating element 24. The open circuit cuts power to the heating element 24 and allows the temperature of the water to cool below the high-limit point.

The sensor probe 18 is electrically connected to the control unit 20. Specifically, the connector 70, or the terminals 81 of the sensor probe 18', are plugged into a receptor on the control unit 20. An output measured across the sensor probe 18 calibrated to temperature is processed by the control unit 20. The control unit 20 generates operating signals based on the temperature readings of the sensor probe 18 and transmits the operating signals to the heating element 24 via the conductive wire 88B.

The operation of the installation 10 will now be described in detail. Using the control unit 20, the desired water temperature is set. The control unit 20 receives inputs from the sensor probe 18 representing the temperature of the water in the water tank 22. The control unit 20 processes these inputs to determine the temperature of the water inside the tank.

If the water temperature is above the desired temperature threshold the control unit 20 stands by until the water temperature decreases. If the water temperature is below the desired temperature the control unit transmits a signal to the heating element 24 to activate the heating element. The heating element remains active until inputs from the sensor probe 18 indicate that the water temperature has increased to the desired level, at which time the control unit 20 deactivates the heating element 24.

The thermostat 14 protects against over heat situations. For example, the direct contact between the thermostat 14 and the exterior surface of the water tank 22 permits the thermostat 14 to monitor the temperature of the water in the tank 22. If the temperature rises above a predetermined temperature, the thermostat 14 opens the circuit that further comprises the power supply 86 and the heating element. Opening this circuit prevents the flow of current to the heating element 24 to deactivate the heating element 24 and allow the water temperature to cool to an acceptable level.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A bracket operable to support at an external surface of a water tank a temperature control device and a sensor probe for controlling and monitoring the water temperature of the water tank, the bracket comprising:

a first receptacle operable to receive the temperature control device, said first receptacle defining a first opening and a second opening, said first receptacle at least substantially surrounding a periphery of said temperature control device while permitting access to a first surface of said temperature control device through said first opening and permitting access to a second surface of said temperature control device through said second opening;

a second receptacle operable to receive the sensor probe; and a coupling feature co-operable with a mounting device fastened to a heating element extending from the external surface of the water tank, said mounting device attaching the bracket at the external surface of the water tank.

2. The bracket of claim 1, further comprising a third receptacle operable to receive a second sensor probe.

3. The bracket of claim 1, further comprising a locking mechanism to secure the temperature control device within said first receptacle.

4. The bracket of claim 3, wherein said locking mechanism includes a clip.

5. The bracket of claim 3, wherein said locking mechanism includes a tab at an interior surface of said first receptacle.

6. The bracket of claim 1, wherein said coupling feature includes a protrusion that extends from an exterior surface of said bracket.

7. The bracket of claim 1, wherein said bracket comprises a phenolic material.

8. A temperature control assembly for controlling and monitoring the water temperature of a water tank, said assembly comprising:

a bracket having a coupling feature;

a thermostat supported by said bracket such that access to both a first surface of said thermostat and a second surface of said thermostat opposite to said first surface of said thermostat is unobstructed by the bracket; and a thermistor supported by said bracket.

9. The temperature control assembly of claim 8, wherein said bracket comprises a phenolic material.

10. The temperature control assembly of claim 8, wherein said coupling feature includes a protrusion that extends from an exterior surface of said bracket.

11. The temperature control assembly of claim 8, wherein said thermostat is a high limit temperature control thermostat.

12. The temperature control assembly of claim 8, wherein said thermistor is included in a sensor probe.

13. The temperature control assembly of claim 8, wherein said thermostat is secured to said bracket with a locking mechanism.

14. A system for controlling and monitoring water temperature of a water tank, said system comprising:

a mount in cooperation with a heating element at an external surface of the water tank;

a bracket supported at the external surface of the water tank by said mount;

a thermostat supported by said bracket;

a thermistor supported by said bracket; and a control unit that receives inputs from said thermistor representing the water temperature and transmits operating commands to the heating element based on said inputs.

15. The system of claim 14, wherein said bracket comprises a phenolic material.

16. The system of claim 14, wherein said thermostat is a high limit temperature control thermostat.

17. The system of claim 14, wherein said thermistor is included in a sensor probe.

18. The system of claim 14, wherein said bracket includes a receptacle operable to receive said thermostat.

19. The system of claim 14, wherein said bracket includes a receptacle operable to receive said thermistor.

20. The system of claim 14, wherein said control unit is an electronic control unit.

21. A bracket for supporting a temperature control device and a sensor probe at an external surface of a water tank comprising:

a first receptacle that receives the temperature control device and mounts the temperature control device in direct contact with the external surface of the water tank;

a second receptacle that receives the sensor probe and mounts the sensor probe in direct contact with the external surface of the water tank; and a coupling feature that cooperates with a mount fastened to a heating element extending from the external surface of the water tank to secure the bracket at the external surface of the water tank.

22. The bracket of claim 21, further comprising a locking mechanism to secure the temperature control device within said first receptacle.

23. The bracket of claim 22, wherein said locking mechanism includes a clip.

24. The bracket of claim 22, wherein said locking mechanism includes a tab at an interior surface of said first receptacle.

25. The bracket of claim 21, wherein said coupling feature includes a protrusion that extends from an exterior surface of said bracket.

* * * * *